US006439529B1

(12) United States Patent
Wong

(10) Patent No.: US 6,439,529 B1
(45) Date of Patent: Aug. 27, 2002

(54) STACKABLE PIZZA BOX SUPPORT

(76) Inventor: Christopher Wong, c/o Alliance Imports 8000 Cooper Ave., Bldg. 38 Glendale, NY (US) 11385

( * ) Notice: Subject to any disclaimer, the term of this patent is extended or adjusted under 35 U.S.C. 154(b) by 0 days.

(21) Appl. No.: 09/817,576

(22) Filed: Mar. 26, 2001

(51) Int. Cl.[7] ..... A47G 29/00; B65D 21/032

(52) U.S. Cl. ..... 248/346.01; 248/346.11; 108/91

(58) Field of Search ..... 248/346.01, 346.11, 248/346.4, 346.5; 211/49.1; 206/252, 541, 499, 511, 821; D7/601; 426/115, 128, 124; 229/199, 906; 108/91, 53.1, 53.3

(56) References Cited

U.S. PATENT DOCUMENTS 2,699,814 A * 1/1955 Kahn ..... 248/188.8
3,100,459 A * 8/1963 Liss et al. ..... 108/53.3
3,180,288 A * 4/1965 McCowan ..... 108/101
3,641,949 A * 2/1972 Monk ..... 108/53.3
4,498,586 A * 2/1985 Vitale ..... 206/525
5,077,050 A * 12/1991 Wall ..... 426/124
5,173,070 A * 12/1992 Gould ..... 446/236
5,341,748 A * 8/1994 Liu ..... 108/53.3
D363,880 S * 11/1995 Liebmann ..... D9/456
5,509,601 A * 4/1996 Drabick ..... 229/199
5,516,036 A * 5/1996 Maultasch et al. ..... 229/125.39
5,791,264 A * 8/1998 McCraney ..... 108/151

* cited by examiner

*Primary Examiner*—Korie Chan
*Assistant Examiner*—Ingrid Weinhold
(74) *Attorney, Agent, or Firm*—Bierman, Muserlian and Lucas

(57) ABSTRACT

The pizza support employs three holes in its platform to allow for stacking of two or more pizza supports, one on top of the other. This provides a reduction in the volume of the pizza supports and a cost savings in both storage and shipping.

14 Claims, 2 Drawing Sheets

STACKABLE PIZZA BOX SUPPORT

BACKGROUND OF INVENTION

1. Field of the Invention

This invention relates to plastic support stands that are used with cardboard boxes in which pizzas are delivered or sold after they have been cooked. The support prevents the top of the box from touching the pizza when the boxes are stacked one on top of the other.

2. Art Related to Invention

Plastic support stands for pizza boxes are known and generally comprise a horizontal platform with three legs of equal length affixed to the bottom of the platform and extending perpendicular therefrom. Such stands are generally made of inexpensive plastic through a molding process. The platform is generally circular having a diameter of about 2 inches while the legs are typically about 1 ½ inches. Such supports are usually placed on the pizza in the middle of the pizza and are used to prevent the top of the box from touching the cooked pizza when another box is placed on top of it. In other words, they provide support for the top of the box.

One of the problems associated with such pizza stands is that they take up a lot of space when they are shipped from the manufacturer to the pizzeria. Although they are light in weight, generally less than 2 ounces, because of their flat platform and the legs, they tend to take up a large volume, most of which is air. As will be appreciated, large volume leads to an added expense for shipping purposes.

Additionally, for storage purposes in the pizzeria, the fact that the support stands are bulky, results in them taking up a lot of space in the pizzeria.

As will be appreciated, space is expensive, not only for the pizzeria but also for the manufacturer who is shipping the supports.

There is a need to reduce the volume taken up by such supports and to reduce the cost of not only storage but also of shipping.

SUMMARY OF INVENTION

A stackable pizza box support has now been invented. By allowing the pizza support to be stacked, less space is used for packaging. This decrease in space provides a cost savings to the manufacturer in his shipping cost as well as a cost savings in storage for the manufacturer at his warehouse and to the pizzeria owner in his shop. In fact, it has been found that by employing the pizza support of the present invention, a 50% reduction in volume is obtained. This means a 200% savings on shipping costs and storage costs because the volume of the pizza supports has been reduced by at least half.

The present invention provides for stacking of the pizza box supports by employing three or more holes in the top of the platform for accommodating the legs of the pizza support. In other words, one pizza support is stacked on top of another by placing the legs of a top pizza support through the holes in the platform of a bottom pizza support. In this manner, one pizza support can be stacked on top of another, thereby reducing the volume of the pizza supports by at least 50%. By employing as many as 9 holes in the platform, four pizza supports can be stacked on one another.

Furthermore, once the pizza supports have been stacked one on top of another, they can be packaged by mating the stacked pizza supports such that the legs of one stack of pizza supports faces the legs of another stack of pizza supports. This likewise reduces the volume necessary for shipping and storage of the pizza supports.

Broadly, the stackable pizza box support of .the present invention comprises:

(a) a circular platform having a circumferential edge, a planar bottom side and a planar top side;

(b) three legs, said legs being equally spaced around said circumferential edge of said platform, each of said legs affixed at one end and extending perpendicular from said bottom side of said platform, each of said legs being equal in length; and (c) three holes extending through said platform, said holes being equally spaced around said circumferential edge of said platform and equidistance between said legs, each of said holes having a diameter large enough to allow said legs to pass through said holes so as to allow stacking of said support.

The number of holes in the platform can be increased from three to six or nine, depending on the number of pizza supports that are stacked one on top of the other. The preferred number of holes, however, is three.

The holes are preferably circular, such that they can accommodate the legs of the upper pizza support, however, the hole can be arcuately shaped so as to accommodate two or more legs. Thus, although there is one hole, the hole itself is arcuate and is of such a dimension that two or three legs can fit through the hole.

The legs are circular in cross section and preferably taper such that the end affixed to the bottom of the platform has a larger diameter than the other end, the end which makes contact with the end of the pizza. The cross-section of the legs, however, is not critical to the present invention but must be taken into account when forming the hole in the platform since the hole must accommodate the leg and allow the leg to pass therethrough. Suitably, the leg has a diameter in the range of about 0.25 inch.

The platform itself generally has a diameter of about 1 inch to about 4 inches and, preferably, about 2 inches and a thickness of about 0.05 inch. The legs are suitably 1.5 inches in length and taper as noted above.

These and other aspects may be more readily understood by reference to one or more of the following drawings.

DETAILED DESCRIPTION OF INVENTION

Figure 1:
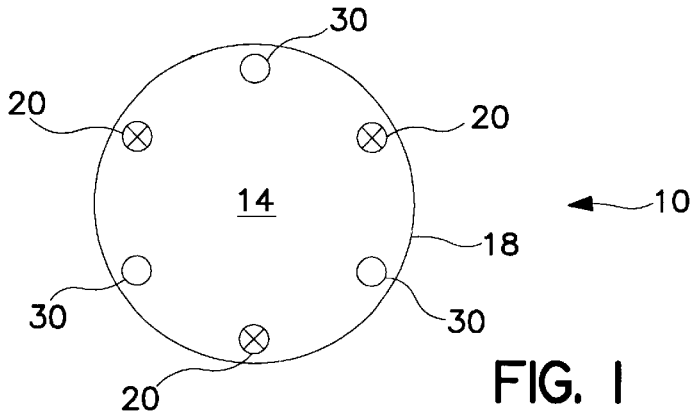
FIG. 1 is a top view of the pizza support of the present invention.
Figure 2:
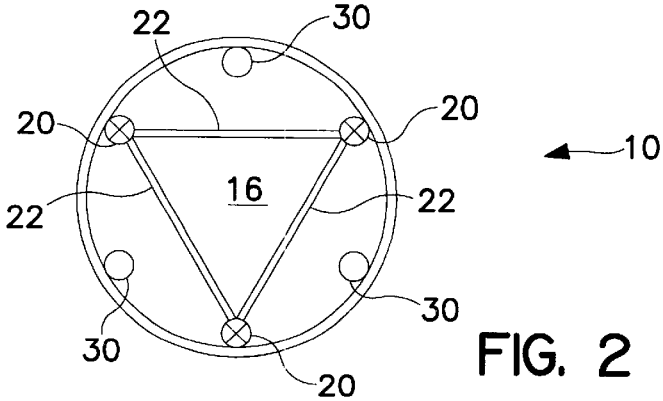
FIG. 2 is a bottom view of the pizza support of the present invention.
Figure 3:
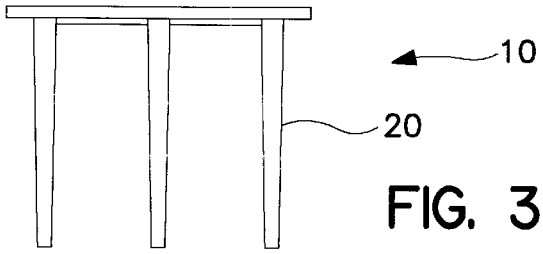
FIG. 3 is a side view of the pizza support of the present invention.

Referring to FIGS. 1, 2 and 3, pizza support 10 comprises a platform 12 which has a planar top surface 14 and a planar bottom surface 16. Pizza support 10 has circumferential edge 18 which define the outer limits of the pizza support 10.

Affixed to bottom surface 16 are legs 20. Legs 20 are equally spaced around the circumferential edge 18 and are affixed to the bottom surface 16 and perpendicular therewith.

Between each of the legs are braces 22. Braces 22 provide support and strength to platform 12.

In platform 12 there are holes 30 which extend completely through the platform. As can be seen in FIGS. 1 and 2, these holes are equally spaced around the circumferential edge of platform 12 and are equidistant between the legs. In other words, referring to the number of degrees, the three legs are set 120° apart from each other while the holes are also set 120° apart from each other. By making them equidistant, the legs are, for example, at 0°, 120°, and 240° while the holes would be placed at 60°, 180°, and 300°. Thus, between the three holes and the three legs, they are equidistant from each other around the circumferential edge of platform 12.

Figure 4:
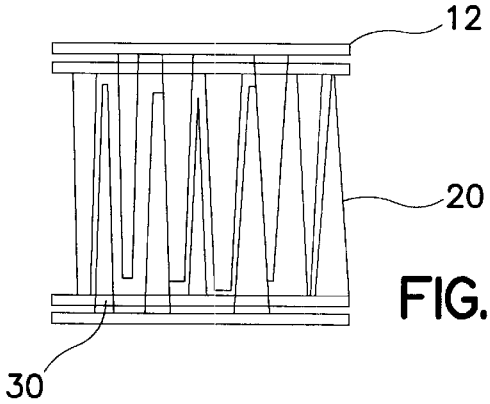
FIG. 4 is a side view of four pizza stands which have been stacked together.

FIG. 4 depicts four pizza stands which have been packaged together. As can be seen, two pizza stands are stacked one on top of the other such that the top pizza support has its legs extending through the holes of the lower pizza support. Then the two stacked pizza supports face each other so that the legs of one pair of stacked pizza supports intermingle with the legs of the other pair of stacked pizza supports. Such an arrangement as shown in FIG. 4 allows for four pizza supports to take up the same volume as would normally be taken up by two pizza supports.

Figure 5:
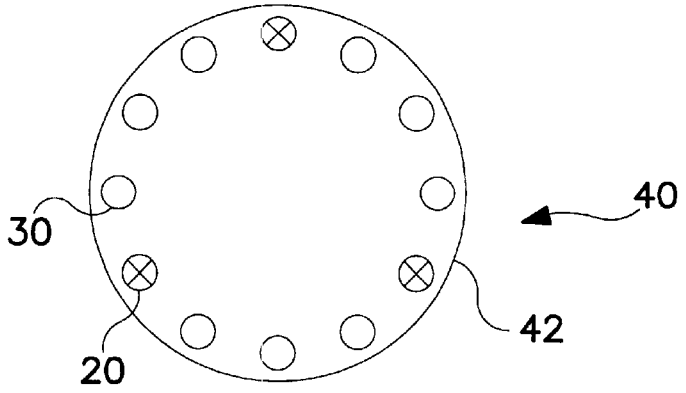
FIG. 5 is a top of a pizza stand having nine holes therein.

Turning to FIG. 5, FIG. 5 shows a pizza support 40 having nine holes in platform 42. Each one of these holes has a diameter so as to accommodate a leg of a pizza support. By employing nine holes, four pizza supports can be stacked on top of another. In this nine hole arrangement, the three legs form a 120° angle with one another while the holes are spaced every 30° between the respective legs. Thus, if the top leg is at 0°, the first hole is at 30°, the second hole is at 60°, the third hole is at 90°, and the second leg is at 120°.

Figure 6:
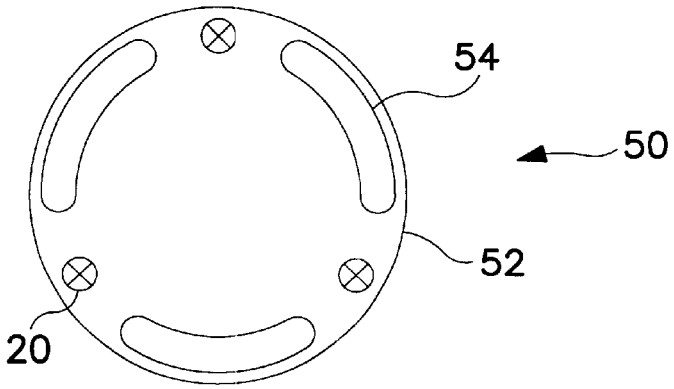
FIG. 6 is a top of a pizza stand having three arcuately shaped holes.

FIG. 6 shows pizza support 50 having platform 52 with arcuate shaped holes 54 therein. Arcuate shaped holes 54 are wide enough to accommodate legs 20. The arch of arcuate holes 54 takes up the same space as combining the three holes as shown in FIG. 5. Thus, four pizza supports can be stacked using the arrangement shown in FIG. 6.

Figure 7:
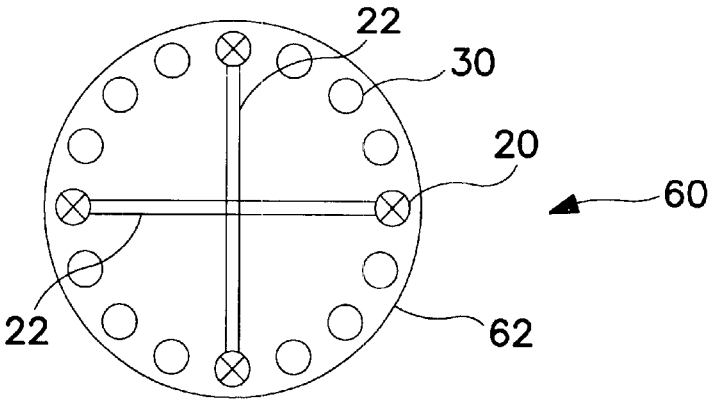
FIG. 7 is a top of a pizza stand with four legs and 12 holes.

FIG. 7 shows pizza support 60 with platform 62 having four legs and four holes 30. As shown in FIG. 7, the legs are spaced 90° from one another while the holes are also spaced 90° from one another but equidistant between the legs. This means that the angle between the leg and the hole is 45°.

The preferred embodiment of the present invention employs three legs and three holes as shown in FIGS. 1–3 because it is a more stable support.

Additionally, in the figures as shown, the platform of the pizza support to be circular. Naturally, it can take on any shape for purposes of molding and saving cost of plastic, however, circular has been shown to be the best.

It will be understood that the claims are intended to cover all changes and modifications of the preferred embodiments of the invention herein chosen for the purpose of illustration which do not constitute a departure from the spirit and scope of the invention.

What is claimed is:

1. A stackable pizza box support comprising:

(a) a circular platform having a circumferential edge, a planar bottom side and a planar top side;

(b) three legs, said legs being equally spaced around said circumferential edge of said platform, each of said legs affixed at one end and extending perpendicular from said bottom side of said platform, each of said legs being equal in length; and (c) three holes extending through said platform, said holes being equally spaced around said circumferential edge of said platform and equidistant between said legs, each of said holes having a diameter large enough to allow said legs to pass through said holes so as to allow stacking of said support.

2. The support of claim 1 wherein a brace extends between each of said legs and is affixed to the bottom side of said platform.

3. The support of claim 1 wherein said legs are tapered with a non-uniform diameter, the diameter of said legs being larger at said one end than at the other end.

4. The support of claim 1 wherein the length of said legs is about 1.5 inches and said platform has a diameter of about 2 inches and a thickness of about 0.05 inch.

5. A stackable pizza box support comprising:

a circular platform having a circumferential edge, a planar bottom side and a planar top side;

three legs, said legs being equally spaced around said circumferential edge of said platform, each of said legs affixed at one end and extending perpendicular from said bottom side of said platform, each of said legs being equal in length; and at least three holes extending through said platform, said holes being equally spaced around said circumferential edge of said platform and equidistant between said legs, each of said holes being large enough to allow said legs to pass through said holes so as to allow stacking of said support.

6. The support of claim 5 wherein a brace extends between each of said legs and is affixed to the bottom side of said platform.

7. The support of claim 5 wherein said legs are tapered with a non-uniform diameter, the diameter of said legs being larger at said one end than at the other end.

8. The support of claim 5 wherein the length of said legs is about 1.5 inches and said platform has a diameter of about 2 inches and a thickness of about 0.05 inch.

9. The support of claim 5 wherein said hole is circular in dimension.

10. The support of claim 5 wherein said hole is arcuate shaped and allows more than one leg to pass therethrough.

11. The support of claim 9 wherein the number of holes is three.

12. The support of claim 9 wherein the number of holes is six.

13. The support of claim 9 wherein the number of holes is nine.

14. A stackable pizza box support comprising:

a circular platform having a circumferential edge, a planar bottom side and a planar top side;

four legs, said legs being equally spaced around said circumferential edge of said platform, each of said legs affixed at one end and extending perpendicular from said bottom side of said platform, each of said legs being equal in length; and four holes extending through said platform, said holes being equally spaced around said circumferential edge of said platform and equidistant between said legs, each of said holes having a diameter large enough to allow said legs to pass through said holes so as to allow stacking of said support.

* * * * *